United States Patent [19]

Anthony

[11] Patent Number: 4,932,721

[45] Date of Patent: Jun. 12, 1990

[54] WATER COUCH

[76] Inventor: Arthur J. Anthony, 326 Grove, Highland Park, Mich. 48203

[21] Appl. No.: 398,375

[22] Filed: Aug. 24, 1989

[51] Int. Cl.[5] ..... A47C 7/02

[52] U.S. Cl. ..... 297/452; 297/455; 297/440; 297/DIG. 3; 5/12 R

[58] Field of Search ..... 297/DIG. 3, DIG. 1, 297/452, 440, 232, 330, 455, 396, 411; 5/451, 452, 12 R, 465

[56] References Cited

U.S. PATENT DOCUMENTS

| | | | |
|---|---|---|---|
| 2,960,152 | 11/1960 | Wendel | 297/411 |
| 4,077,666 | 3/1978 | Heumann | 297/440 |
| 4,143,909 | 3/1979 | McFarlin | 5/451 X |
| 4,163,297 | 8/1979 | Neumark | 5/451 X |
| 4,561,137 | 12/1985 | Smitherman | 5/12 R |
| 4,761,011 | 8/1988 | Sereboff | 297/455 X |
| 4,838,613 | 6/1989 | Smith | 297/DIG. 3 |

*Primary Examiner*—Laurie K. Cranmer

[57] ABSTRACT

The present device relates to a couch, which is comprised of a flexible material (Poly Vinyl Chloride) completely filled with water. The inside of the couch (all the pillows and cushion) is sectioned off by many walls of partitions, some are situated vertically affixing the upper surface to the lower surface from the front edge to the back edge and some are situated longitudinally affixing the left side edge to the right side edge. These walls are made of the same flexible material as the couch. They keep the water at minimum motion. Thus enabling a human body to sit on the couch without excess movement of water. A person can lean on the couch or sit on the edge of the couch without the water escaping that particular pressure point.

2 Claims, 5 Drawing Sheets

WATER COUCH

SUMMARY OF THE INVENTION

The present invention relates to a couch, which is comprised of a flexible material (Poly Vinyl Chloride) completely filled with water. The inside of the couch (all the pillows and cushion) is sectioned off by many walls or partitions which connect the upper surface to the lower surface from the front edge to the back edge and in some areas from the left side edge to the right side edge. These walls are made of the same flexible material. They keep the water at minimum motion. Thus enabling a human body to sit on the couch without excess movement of water. A person can lean on the couch or sit on the edge of the couch without the water escaping that particular pressure point.

My invention consitutes comfort for ailing back problems or for just plain relaxation for anybody. This particular design consist of six pillows and one seat cushion all completely filled with water, mounted on a wood frame. The wood frame has snaps screwed onto it to secure the pillows and seat cushion. Four of the pillows snap to the backboard of the frame, while the other two pillows snap to the armrests on either side. The snaps on the wood frame are actually screws with the head of the screw being the snap.

BACKGROUND ART

The following are prior art references related to the couch of the instant invention:

U.S. Pat. Ser. No. 4,726,624 to Jay
U.S. Pat. Ser. No. 3,999,539 to Meador
U.S. Pat. Ser. No. 4,189,181 to Noble et al
U.S. Pat. Ser. No. 4,738,486 to Surber.

BRIEF DESCRIPTION OF THE DRAWINGS

The present invention will be further described with reference to the accompanying drawing wherein like reference numerals refer to like parts in the several views, and wherein.

DETAILED DESCRIPTION

Figure 1:
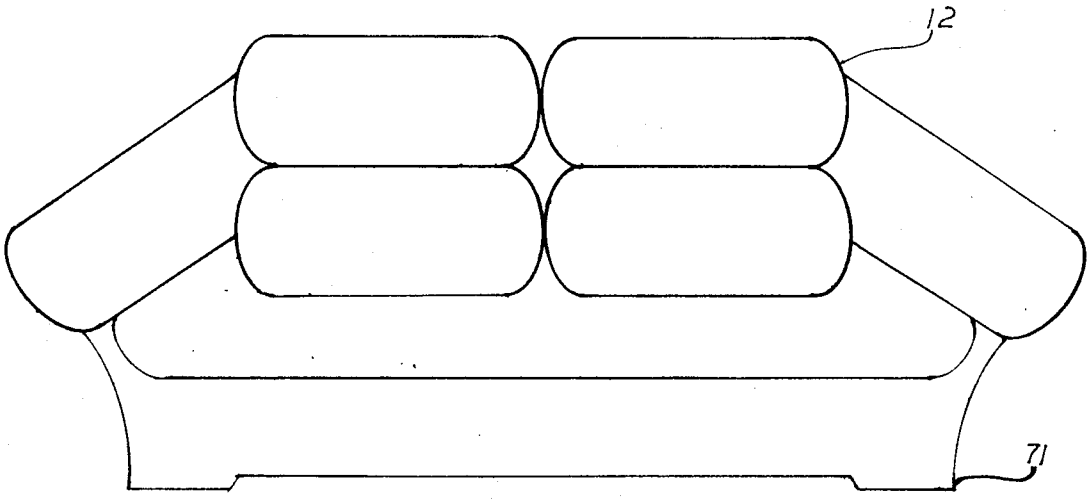
FIg. 1 is a front view of the water couch according to the present invention.

The water couch is shown generally in FIG. 1. It is comprised of cushions formed from Poly Vinyl Chloride which are mounted on a wood frame 71.

Figure 2:
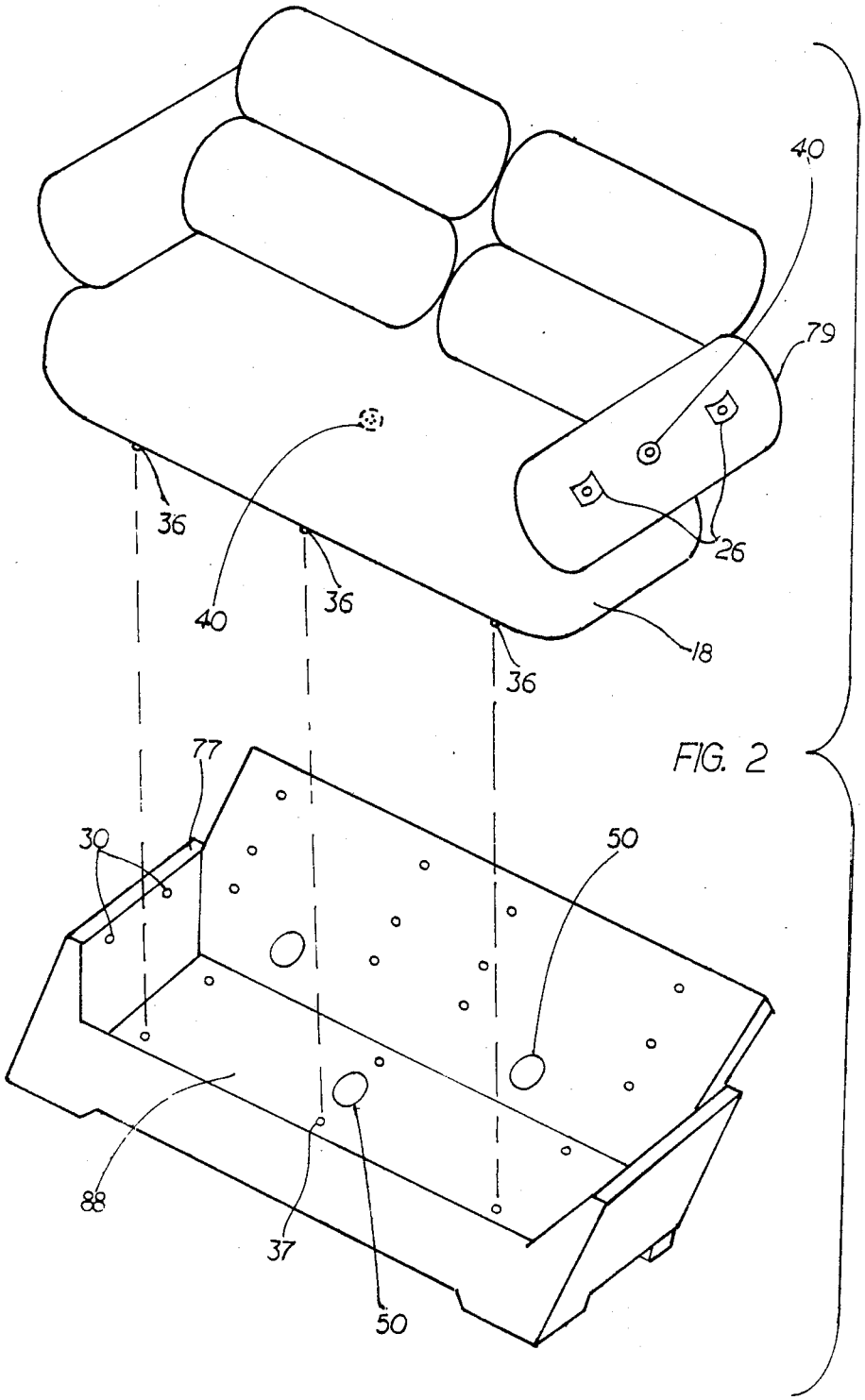
FIG. 2 is an exploded perspective view of the cushions and frame of FIG. 1.
Figure 3:
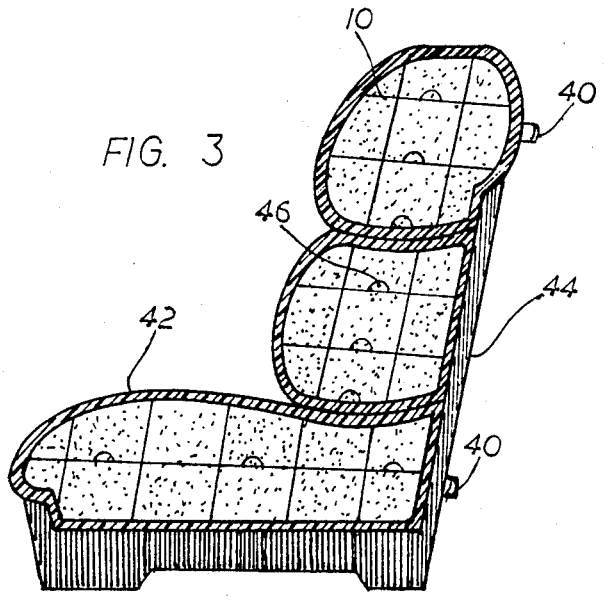
FIG. 3 is a cross sectional side elevation of the couch of FIG. 1.
Figure 4:
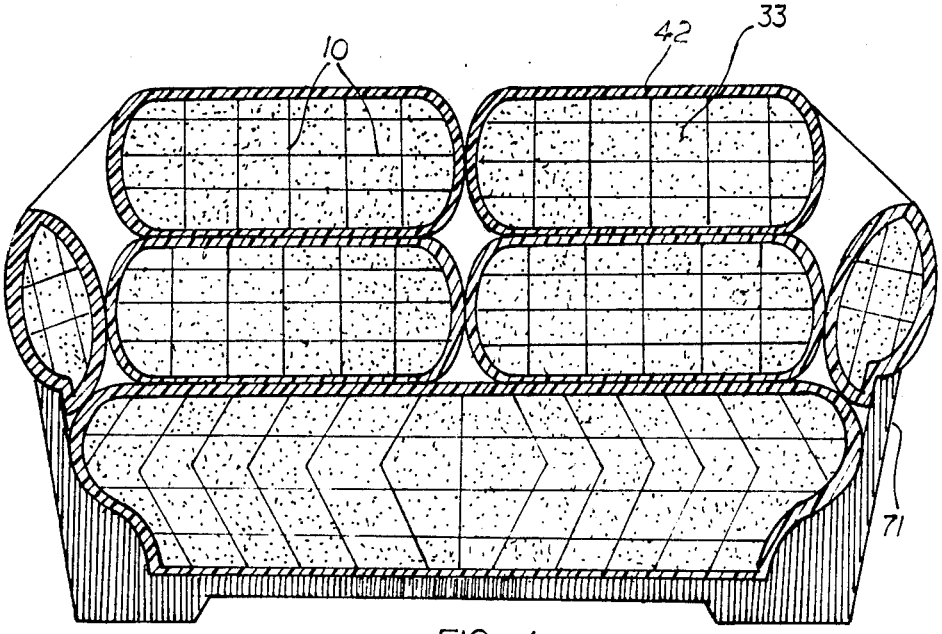
FIG. 4 is a cross sectional front elevation of the couch of FIG. 1.
Figure 5:
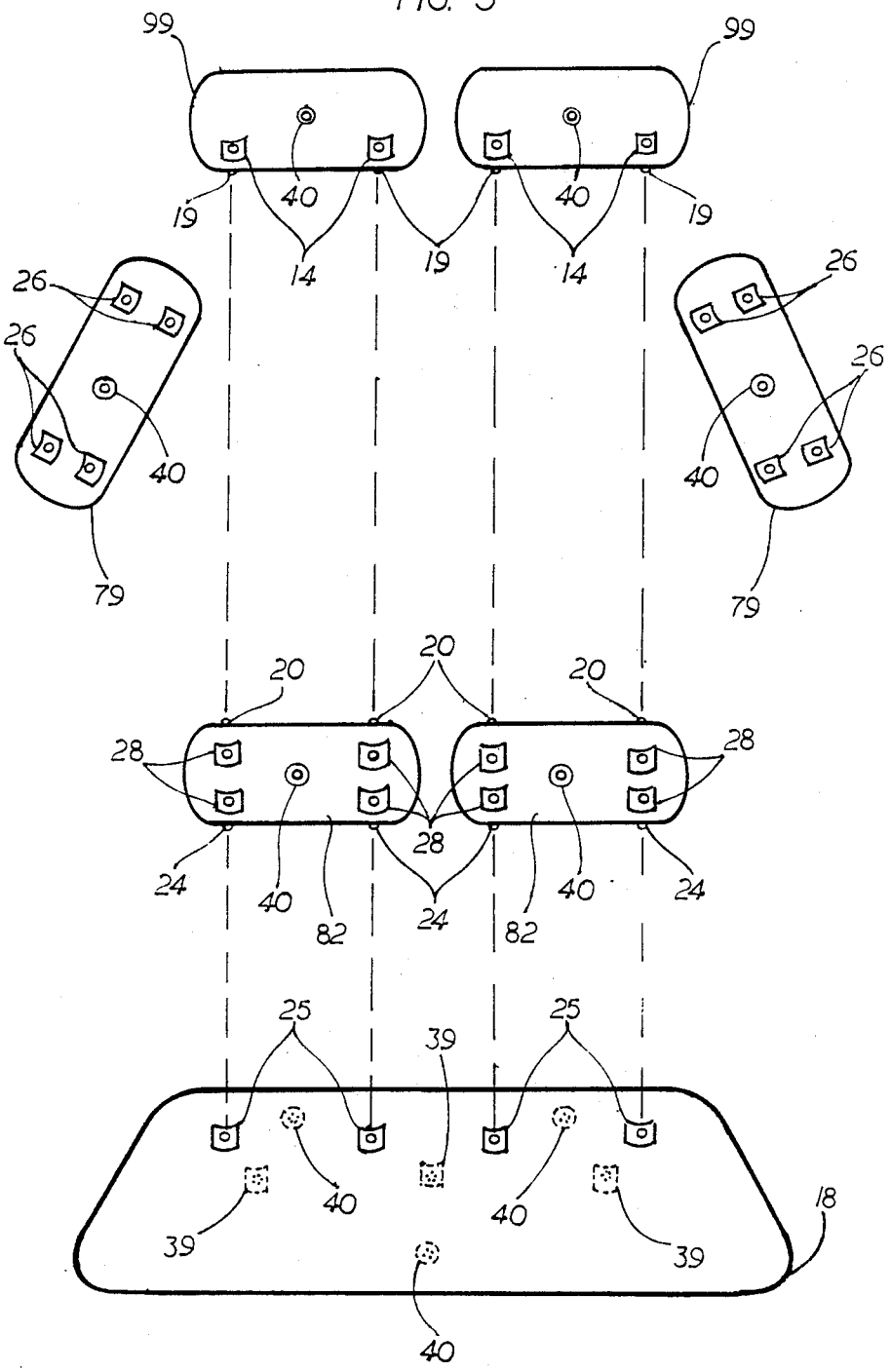
FIG. 5 is an exploded view of the cushions of the present invention.
Figure 6:
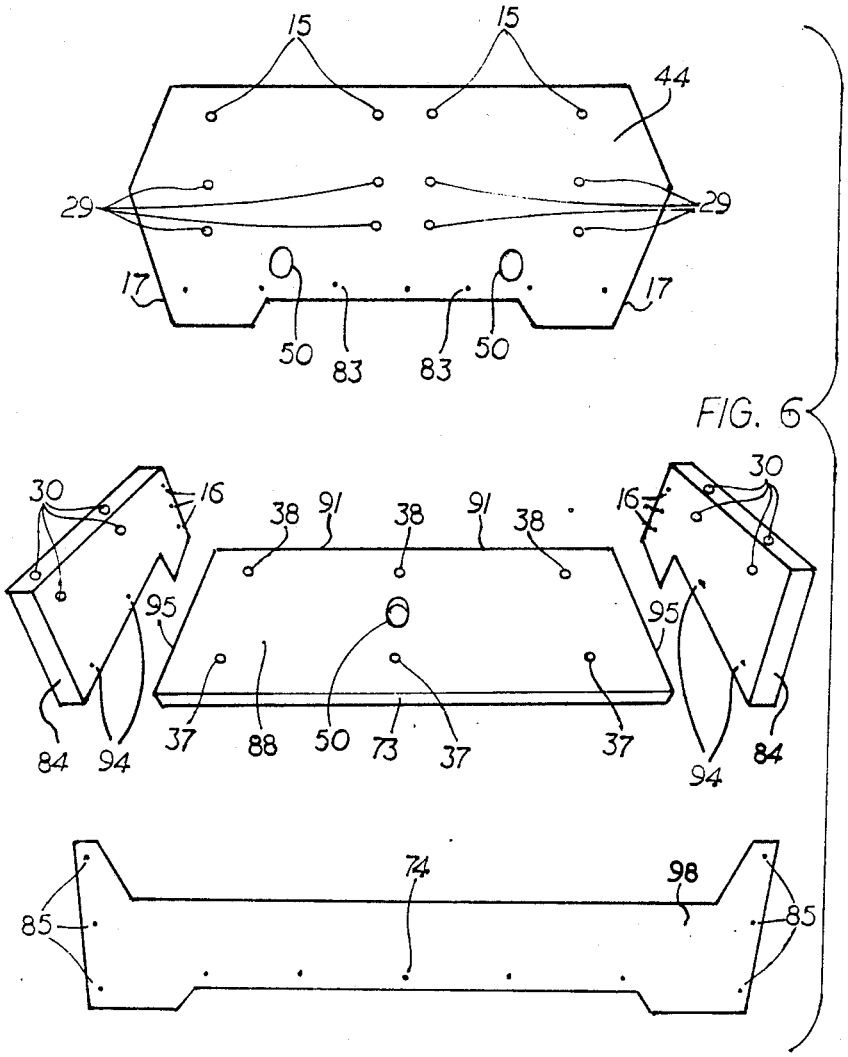
FIG. 6 is an exploded view of the frame of the present invention.

FIG. 2 shows the water couch with armrest 79 turned over to view snaps 26 that snap into snaps 30 on the wood frame armrest 77. Note that either armrest pillow will fit on the left or the righ side of the wood frame. A water inlet valve or drain 40 is disposed on the armrest pillow for use in filling and draining the pillows. A drain 40 located on the bottom of seat cushion 18 can be operated through hole 50 in the baseboard 88 of the wood frame, and is recommednded for draining use only because of its location. There is also a drain or water inlet valve 40 on the left and right sides of the seat cushion 18 that protrude through holes 50 in the left and righ sides of the wood frame backboard 44. Three snaps 36 located at the front base of the seat cushion 18, snap into three snaps 37 located near the front of the wood frame baseboard 88.

The inside of each of the cushions and pillos has inner walls or partitions 10, also formed from Poly Vinyl Chloride, extending vertically and horizontally thereby froming a plurality of compartments within each cushion for keeping the motion of the water within the cushions to a minimum. There is a hole 46 in each partition 10 such that each compartment within one cushion communicates with every other compartment within that cushion. Additionally, the longitudinal partitions prevent excess sagging in the pillows and cushions.

The top pillows 99 have snaps 14 that snap into snaps 15 located near the top of the wood frame backboard. Either top pillow can fit either side on the backboard. There is also a drain or water inlet valve 40 on the pillows as there is on all the pillows. The snaps 19 on the bottom of the pillows snap into snaps 20 on the top of the bottom pillows 82. Snaps 28 on the bottom pillows snap into snaps 29 in the middle of the wood frame backboard 44. Either bottom pillow fits either side of the backboard. The snaps 24 on the bottom of the pillows snap into snaps 25 on the top of the seat cushion 18. Snaps 39 located on the bottom toward the rear of the seat cushion 18 snap into snaps 38 located toward the back of the baseboard 88 of the wood frame. Snaps 26 on the armrest pillows cooperate with snaps 30 on the wood frame armrest.

Screws 83 located toward the bottom of the backboard screw into the back edge 91 of the baseboard 88; screws 16 near the back of the wood frame armrest screw into the lower side edge 17 of the backboard 44; screws 94 located near the bottom of frame armrest screw into side edges 95 of the baseboard 88; screws 85 near to sides of the front board 98 screw into the font edge 84 of the frame armrewsts; and screws 74 screw into the front edge 73 of the baseboard 88, thereby assembling the wood frame.

Figure 7:
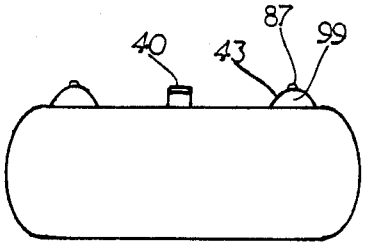
FIG. 7 is a side view of a pillow according to the present invention.

The snaps on all the pillows and cushions are attached thereto in the following manner, and as best seen in FIG. 7. The snap elements 87 are mounted on a hard or stiff rubber band 43. Each end of the band 43 is glued to the pillow leaving a space 99 between the band and the pillow for finger room to snap the snaps together. The cooperating snaps on the wood frame are actually screws with the head of the screw being the cooperating snap element.

Having thus described my invention, I claim:

1. A water couch, comprising:

A plurality of water-filled cushions mounted on a wood frame;

said cushions each having a plurality of horizontal and vertical partitions forming a plurality of compartments therein, wherein said partitions each have an opening therein for communicating with an adjacent compartment, whereby said partitions prevent excessive water movement within said cushions and support said cushions to prevent excessive sagging; at least one valve disposed on each cushion for filling and discharging water therefrom; and a plurality of snaps disposed on each cushion for attaching selected cushions to each other and to the wood frame, wherein each snap includes a snap element attached to a stiff band of rubber having two ends, each of the two ends being attached to a respective one of said cushions such that a finger space exists between said band of rubber and said respective cushion for manipulation of said snap;

said wood frame comprising a backboard, a baseboard, two frame armrests, and a frontboard all of which are screwed together to form a seating frame member; two holes are located in said backboard and one hole is located in said baseboard to access said valves when said cushions are connected to said wood frame; and a plurality of corresponding snaps attached to said backboard, said baseboard, and said two frame armrests for cooperation with said snaps disposed on said cushions to thereby connect said cushions to said wood frame, wherein said corresponding snaps comprise screws having snap elements as heads.

2. The couch of claim 1 wherein said plurality of cushions comprises four backrest cushions, two armrest cushions and a seat cushion.

* * * * *